US010418753B2

(12) United States Patent
De Geest et al.

(10) Patent No.: US 10,418,753 B2
(45) Date of Patent: Sep. 17, 2019

(54) CONNECTOR ASSEMBLY WITH LOW PAIR CROSS TALK

(71) Applicant: Amphenol FCI Asia PTE. LTD., KA Place (SG)

(72) Inventors: Jan De Geest, Wetteren (BE); Stefaan Sercu, Brasschaat (BE)

(73) Assignee: Amphenol FCI Asia Pte. Ltd., Singapore (SG)

( * ) Notice: Subject to any disclaimer, the term of this patent is extended or adjusted under 35 U.S.C. 154(b) by 0 days.

(21) Appl. No.: 14/763,243

(22) PCT Filed: Jan. 24, 2013

(86) PCT No.: PCT/IB2013/000364
§ 371 (c)(1),
(2) Date: Jul. 24, 2015

(87) PCT Pub. No.: WO2014/114972
PCT Pub. Date: Jul. 31, 2014

(65) Prior Publication Data

US 2015/0372427 A1 Dec. 24, 2015

(51) Int. Cl.

| | |
|---|---|
| ***H01R 13/648*** | (2006.01) |
| ***H01R 13/6466*** | (2011.01) |
| ***H01R 13/6471*** | (2011.01) |
| ***H01R 13/6587*** | (2011.01) |
| ***H01R 12/71*** | (2011.01) |

(52) U.S. Cl.
CPC ..... *H01R 13/6466* (2013.01); *H01R 12/71* (2013.01); *H01R 13/6471* (2013.01); *H01R 13/6587* (2013.01)

(58) Field of Classification Search
CPC ..... H01R 13/65802; H01R 23/688; H01R 23/6873; H01R 12/57
USPC ..... 439/79, 83, 607.01, 607.07, 607.09, 439/607.1, 607.11, 607.13, 607.32
See application file for complete search history.

(56) References Cited

U.S. PATENT DOCUMENTS

| | | | | |
|---|---|---|---|---|
| 5,895,278 | A | 4/1999 | Humphrey | 439/101 |
| 6,471,548 | B2 * | 10/2002 | Bertoncini | H01R 23/688 439/607.1 |
| 6,692,272 | B2 * | 2/2004 | Lemke | H01R 13/6474 439/108 |

(Continued)

FOREIGN PATENT DOCUMENTS

WO WO 2013/075693 A1 5/2013

OTHER PUBLICATIONS

European Communication for European Application No. 13724618.7 dated Mar. 10, 2017.

*Primary Examiner* — Thanh Tam T Le
(74) *Attorney, Agent, or Firm* — Wolf, Greenfield & Sacks, P.C.

(57) ABSTRACT

A connector is provided having a plurality of leads generally arranged in columns extending substantially parallel each other in a column direction and being adjacent each other in a row direction. At least one first column includes at least one first pair of signal leads substantially parallel each other in a first pair direction to form a first differential pair. In at least a portion of the connector the first pair direction extends at an acute angle to the column direction. Further, an assembly, and a circuit board are provided.

19 Claims, 9 Drawing Sheets

(56) References Cited

U.S. PATENT DOCUMENTS 6,976,886 B2 * 12/2005 Winings ..... H01R 13/6471 439/701
7,094,102 B2 * 8/2006 Cohen ..... H05K 1/14 439/607.08
7,108,556 B2 * 9/2006 Cohen ..... H01R 23/688 361/788
7,182,643 B2 * 2/2007 Winings ..... H01R 29/00 439/607.39
7,467,955 B2 * 12/2008 Raistrick ..... H01R 13/26 439/75
7,651,373 B2 * 1/2010 Knaub ..... H01R 23/688 439/108
7,674,133 B2 * 3/2010 Fogg ..... H01R 12/712 439/108
7,837,505 B2 * 11/2010 Minich ..... H01R 12/727 439/607.08
7,914,305 B2 * 3/2011 Amleshi ..... H01R 13/6471 439/101
8,215,968 B2 * 7/2012 Cartier ..... H01R 13/6474 439/83
8,251,745 B2 * 8/2012 Johnescu ..... H01R 13/6471 439/607.1
8,444,436 B1 * 5/2013 Cohen ..... H05K 1/115 439/607.08
8,475,183 B2 * 7/2013 Chien ..... H01R 12/585 439/101
8,535,065 B2 * 9/2013 Costello ..... H01R 13/6585 439/607.03
8,556,657 B1 * 10/2013 Nichols ..... H01R 13/6471 439/607.07
8,905,785 B2 * 12/2014 Johnescu ..... H01R 13/65807 439/607.03
2006/0024983 A1 2/2006 Cohen et al. ..... 439/61
2008/0045079 A1 2/2008 Minich et al.
2009/0311908 A1 12/2009 Fogg et al.
2011/0275249 A1 11/2011 Cartier et al. ..... 439/660
2012/0202380 A1 8/2012 Lappoehn

* cited by examiner

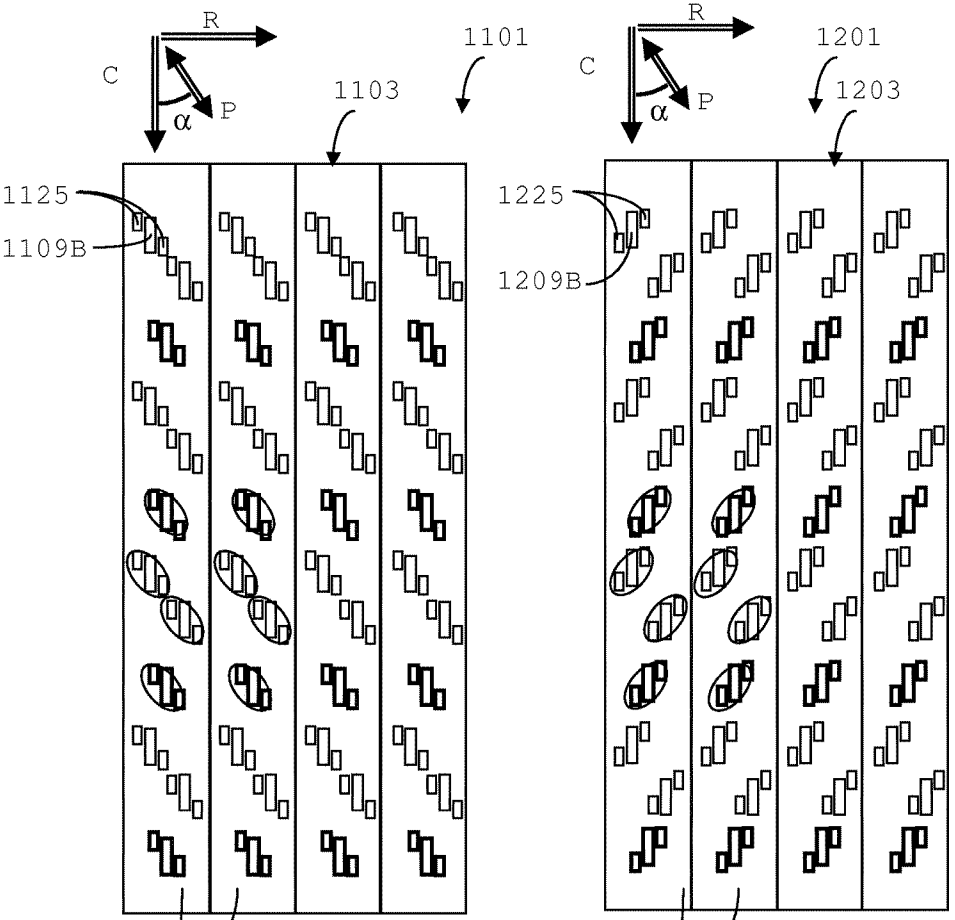
Fig. 16
Fig. 17
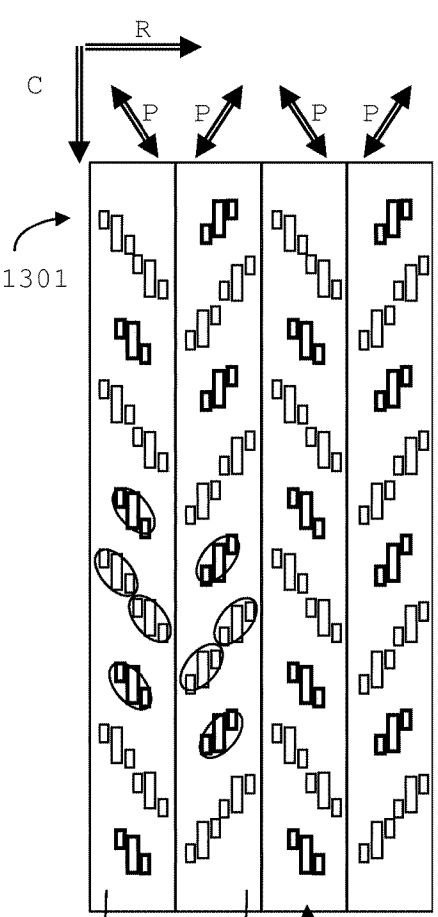
Fig. 18

CONNECTOR ASSEMBLY WITH LOW PAIR CROSS TALK

TECHNICAL FIELD

The present disclosure relates to the field of electrical connections, in particular for high-speed signal transmission.

BACKGROUND

A well-known technology for high-speed signal transmission is differential signal transmission. A connector and/or a circuit board may therefore comprise plural leads arranged in differential signal pairs. However, it has been found that differential signal pairs exhibit cross talk, in particular pair-cross talk, which reduces signal integrity. Obviously, this is undesired. The cross talk noise tends to increase with proximity between adjacent differential signal pairs and with increasing signal speed.

However, there is an ongoing trend for smaller and faster electronic devices and power reduction for signals. Cross talk noise is thus set to become an increasing problem.

Consequently, improved connectors are desired to address the above conflicting demands.

SUMMARY

Herewith, an assembly according to claim 1 is provided. The connector comprises a plurality of leads generally arranged in columns extending substantially parallel each other in a column direction and being adjacent each other in a row direction. This facilitates its design and manufacturing. E.g., it facilitates incorporation of the connector in a regular grid and/or combination with other connectors or devices. At least one first column comprises at least one first pair of signal leads substantially parallel each other in a first pair direction to form a first differential pair. This allows differential signal transmission. Parallelism of the leads assists reducing surface area spanned between the leads and it may reduce different noise influences on the individual leads, both improving signal integrity. In at least a portion of the connector the first pair direction extends at an acute angle $\alpha$ to the column direction. Thus, the surface area spanned by the first differential pair in the connector portion under concern is arranged at the first pair direction. Hence, the effective differential pair surface area perpendicular to the column direction is reduced to about cos $\alpha$, so that picking up of noise by the differential pair from signals in adjacent columns is reduced correspondingly.

The connector may comprise a plurality of such differential pairs arranged in a pair direction at an acute angle to the column direction, providing improved performance for these pairs.

In the case of claim 2, mutual inductance between adjacent differential pairs and thus pair cross talk in the adjacent columns is reduced. The pairs may be arranged in columnar fashion. Effectively, the first and second pairs may be staggered, considered in a direction substantially perpendicular to the pair direction, further reducing overlap of the surface areas of the pairs.

In the connector of claim 3, the mutual inductance between the first and second differential pairs is effectively reduced and may be minimal. Thus, the pair cross talk between the first and second differential pairs may be minimal.

In an alternative, in at least a portion of the connector in adjacent first and second columns the first and second pair directions are generally opposite, preferably substantially perpendicular to each other. In such case, the differential signal pairs may be arranged adjacent each other with little to no mutual inductance and little to no cross talk effect on each other. In a modular connector, this may require different modules, possibly arranged alternating. Potential increased costs may be outweighed by improved signal integrity and/or performance.

In the connector of claim 4, adjacent differential pairs within one column are shielded from each other by the ground leads, improving signal integrity.

In the connector of claim 5, differential pairs in adjacent columns are shielded from each other by the shields, improving signal integrity.

In the connector of claim 6, the shield contacts may be arranged to account for impedance and/or shielding differences for the signal leads, in particular at or near contact portions of the leads. Shield contacts extending outside the plane on opposite sides allows arranging the contacts appropriately, in particular symmetrically with respect to the signal leads in columns on opposite sides of the shields. Further, contact and/or conductor layout of a further object connected to the connector, e.g. a circuit board or a counterconnector may be facilitated and/or improved.

The connector of claim 7 facilitates manufacturing the connector and further objects such as a counterconnector or a circuit board to be connected to the connector, in particular with respect to tracing leads and/or determining contact pitches. Also, mechanical forces may be distributed evenly. Also, (cross talk) noise effects of leads, in particular of differential signals pairs, may be substantially predictable and/or substantially constant for different pairs in the connector.

The connector of claim 8 facilitates manufacturing the connector from modules that may be manufactured cost-effectively. Further, different pinouts and/or sizes for the connector may be provided by selecting different modules. The connector may comprise substantially identical or different modules, possibly a number of modules which are mirror-images of each other. Use of identical modules generally reduces manufacturing costs.

As defined in claim 9, one or more modules may comprise sub-modules, e.g. to provide a certain pitch.

Shields may be arranged between modules. The modules may be mounted in a housing to form the connector, which may have a generally rectangular shape due to the row of modules.

In another aspect the assembly of claim 10 is provided. The connector may be connected, preferably releasably, with the counterconnector e.g. for interconnecting different devices. The connector may also be connected, possibly releasably, with the circuit board. The contacts may comprise press-fit contacts, solder contacts and/or other contacts, e.g. surface mount contacts such as a ball grid array and/or a pin grid array.

In the assembly of claim 11, the mated contact and counter contact provide a reliable electrical contact with relatively little material. At least one of the contacts may be a tuning fork contact. The orientation of the elongated shape of the contacted contact and counter contact along the differential pair direction, e.g. having an effective angle between the pair direction and the elongated shape direction of less than about 45 degrees, retains or even enhances the differential pair direction in that mating portion of the (counter-)contacts. In the mating portion the open area between the conductive masses for each lead of the differential pair concerned may be reduced, reducing noise pick-up of the pair. Hence, the cross talk properties may be substantially constant or locally even improved along the signal leads. In an embodiment wherein the elongated shape of the conductive mass is rotated against the pair direction, e.g. having an effective angle between the pair direction and the elongated shape direction of more than about 45 degrees, a relatively large separation between the leads of the pairs in the mating portions may be achieved, providing electrical and mechanical robustness. Further, capacitive coupling between the leads of one differential pair in the mating portion may be increased, facilitating providing a desired impedance in the mating portion.

The counterconnector may advantageously also be a connector as specified before.

In the assembly of claim 12, tracing of leads in or on the circuit board and/or allocation of real estate on the board may be facilitated. Also, mechanical strength of the board may be improved. Also, thermal management of the board during soldering and/or solder reflow processes may be improved. Also, noise and/or impedance for different leads and/or differential pairs may be substantially similar or constant in different leads in or on the board.

Also, in the assembly of claim 13, the circuit board may comprise a footprint for accommodating a connector having a substantially rectangular or elongated shape with respect to column and row directions perpendicular to each other, and having differential pair contacts arranged generally in lines at an acute angle to the column and row directions.

In the circuit board of claim 14, enlarged ground contacts are provided which facilitate connecting, e.g. receiving large contacts and/or plural contacts of leads and/or shields. This also allows for significant amounts of shielding material and/or large tolerances. Further, in case of use with plural connector contacts contacted to one enlarged ground contact, ground loops are prevented.

In another aspect, an assembly is provided comprising a connector comprising a plurality of leads comprising differential signal pairs, the leads being arranged in first columns, the assembly comprising a second object connected or connectable with the connector, the second object comprising a plurality of contacts for contacting the connector contacts, being generally arranged in second columns, characterised in that the first and second columns are arranged at an acute angle to each other. At least some of the first columns may be provided by lead modules or lead frame assemblies in insulating housings.

BRIEF DESCRIPTION OF THE DRAWINGS

The above-described aspects will hereafter be more explained with further details and benefits with reference to the drawings showing an embodiment of the invention by way of example.

FIG. 16-18 show contact-counter contact arrangements in cross section.

DETAILED DESCRIPTION OF EMBODIMENTS

Figure 1:
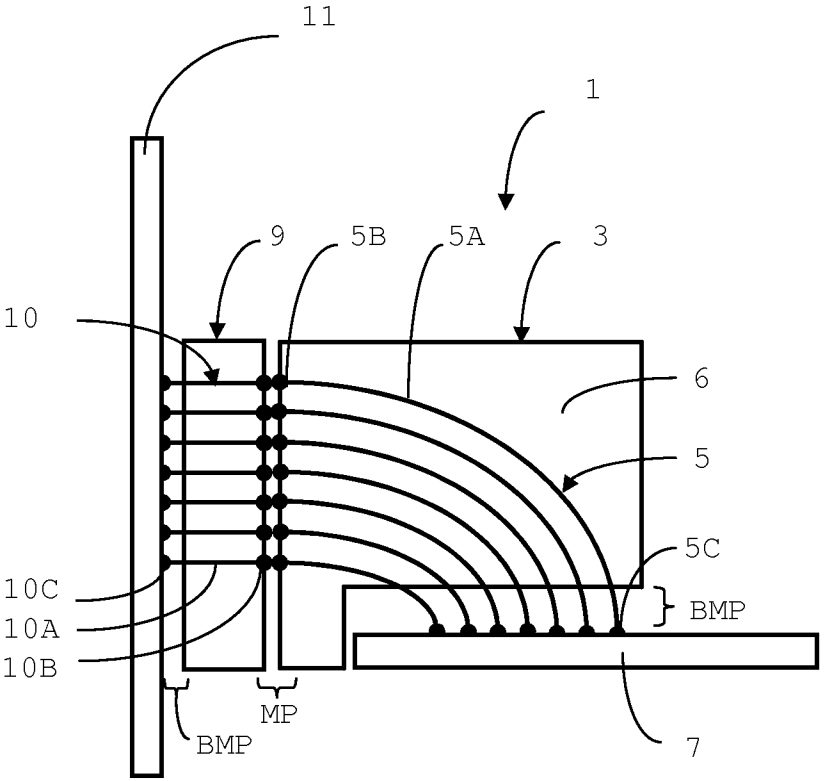
FIG. 1 shows a connector connected to a first circuit board on one side and connected via a header to a second circuit board on another side.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified.

FIG. 1 shows an assembly 1 comprising a connector 3 comprising a plurality of leads 5 in an insulating material 6. The connector is connected to a first circuit board 7 on one side and on another side to a counterconnector 9 in the form of a header 9 having leads 10. On the opposite side from the connector 3, the header 9 is connected to a second circuit board 11. All leads 5, 10 comprise a lead portion 5A, 10A, and first contact portions 5B, 10B, on one end for contacting an associated lead 10, 5 of the mated connector 9, 3 in a mating portion MP. The leads 5, 10, further comprise second contact portions 5C, 10C, on their opposite end for contacting a respective further object to be contacted, here the first and second circuit boards 7 and 11, respectively. The mating contacts 5B, 10B may be partly or fully enveloped in dielectric housing material of the connector and/or counterconnector (not shown), when mated. Board connectors 5C, 10C may be generally exposed from connector housing material in respective board mounting portions BMP. The shown connector 3 is a right-angle connector, but the disclosure and the concepts disclosed herein are not limited to such connector and any angle including a straight mezzanine connector may be provided.

Figure 2:
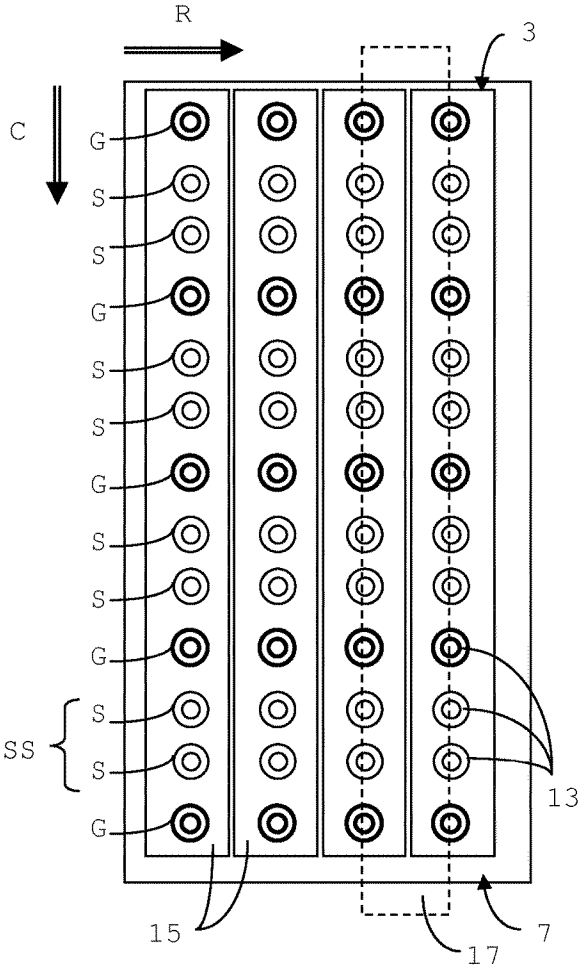

FIG. 2 shows the footprint of a conventional connector 3 on a portion of the first circuit board 7. The circuit board 7 comprises a plurality of contacts generally indicated with 13 arranged in a regular grid pattern of columns in a column direction C and rows in a row direction R substantially perpendicular to the column direction C. Each contact 13 may comprise a surface mount contact and/or a (plated) via extending into the circuit board 7.

Indicated in FIG. 2 is that the connector 3 is of modular construction comprising a plurality of lead modules 15 having a plurality of leads 5 in a dielectric carrier. To form the connector 3 the modules 15 are attached to each other, e.g. being received in an insulating housing (not shown). The modules 15 provide the columnar arrangement. Here, the contacts 13 correspond to the positions of the leads 5 in the connector 3, which leads extend substantially perpendicular to the shown plane of FIG. 2, on a perpendicular scale sufficiently small that the curvature of the right angle is not discernible. In other words, the pattern shown in FIG. 2 corresponds to a cross sectional plane substantially perpendicular to the direction of the leads 5 at that cross section. Such pattern may be substantially constant throughout the connector 3, but there may also be portions in which the shape and/or separation of the leads 5 may vary in the column direction C and/or different amounts of dielectric material of the carrier may be provided, e.g. for reasons of impedance matching.

In FIG. 2 a column 17 is indicated in phantom, defined by the contacts 13 on the circuit board. The column 17 is parallel to and offset from the columns 15 of the connector 3. In such column 17 traces on the circuit board may be arranged substantially without interference of and/or by the contacts 13.

In FIG. 2, all modules 15 are substantially identical. Within each column, the leads 5 are arranged generally in a plane in the column direction C in a regular repetitive ground G-signal S-signal S-ground G pattern. In significant portions of the connector, at least the signal leads S extend substantially parallel to each other in a first pair direction along the column direction C and form a first differential pair SS. In a curved section of the connector 3 this may result in curves with different effective radii. In the column direction C, the differential signal pairs SS are separated by a ground lead G, which may extend substantially parallel to the signal leads. Here and in the following, ground leads or ground contacts are marked in heavy lines, and signal leads or contacts are marked in thin lines. The pairs SS of signal leads S in adjacent modules 15 are adjacent each other. Hence, surface area spanned between the leads of the differential pairs SS in adjacent columns 15 face each other, leading to the pairs SS having a large mutual inductance. Thus, pair cross talk between adjacent differential pairs SS in adjacent columns 15 may be a problem.

Figure 3:
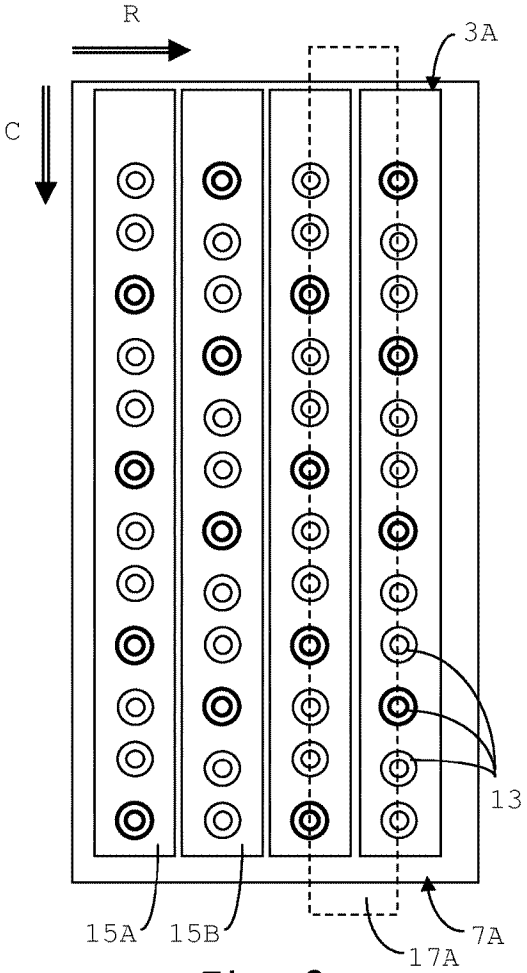
FIGS. 2 and 3 indicate footprints of known assemblies.

FIG. 3 shows a known improvement over FIG. 2 in an assembly 1A of a connector 3A and a circuit board 7A comparable to the assembly 1 of FIG. 2. Here, the connector 3A comprises alternating modules 15A, 15B providing columns in which the ground leads G and signal leads S are arranged differently. As a result, the differential pairs SS of this connector 3A are arranged in a staggered manner, reducing overlap between differential pairs in adjacent columns. On the circuit board 7A comprises columns 17A parallel to and offset from the columns formed by the modules 15A, 15B of the connector 3A. This arrangement shows less cross talk than that of FIG. 2. However, the arrangement of FIG. 3 requires two different modules 15A, 15B to assemble the connector 3A, which may increase costs with respect to the assembly of FIG. 2.

Embodiments of presently disclosed improvements are explained hereafter with reference to FIGS. 4-18, adopting the reference numbers used before but increased by 100, 200, etc.

Figure 4:
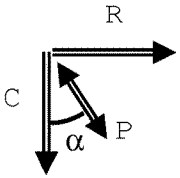
Figure 4:
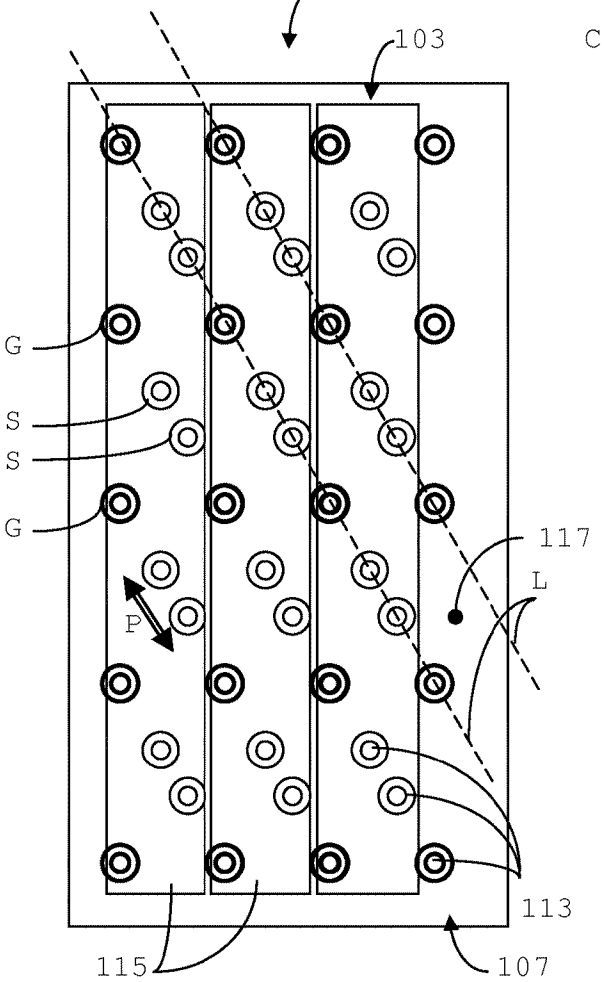

FIG. 4 shows, similar to FIGS. 2-3, the footprint of an improved assembly 101 with a connector 103 of the general type of FIGS. 2 and 3 on a connector portion of the first circuit board 107. The connector 103 comprises a plurality of lead modules 115 providing columns extending in the column direction C and being adjacent each other in the row direction R. Each module 115 comprises ground leads 105 (G) and signal leads 105 (S) arranged in the column provided by the module 115. In each module 115 the signal leads S are pairwise substantially parallel each other and lie adjacent each other in a pair direction P, forming differential pairs SS at an acute angle $\alpha$ to the column direction C. In FIG. 4, the ground leads G extend substantially parallel to the signal leads S and lie adjacent, in the pair direction P, to the signal leads S of an adjacent differential pair SS in the module. In the column direction C of the connector 103, the differential pairs SS are separated by a ground lead G.

In FIG. 4, adjacent modules 115 are substantially identical, and the pair directions P of differential pairs SS in adjacent columns are generally parallel to each other. The signal and ground leads S, G, are arranged in each module 115 such that in the shown contact portion the signal leads S and the ground leads G are arranged along substantially straight lines L in the pair direction P spanning plural adjacent columns 115. Thus, the lines L provide lines of differential pairs SS separated by a ground lead G, here extending substantially parallel to each other. In adjacent lines L the differential pairs SS are arranged in a staggered manner. Thus, in the embodiment of FIG. 4, a staggered arrangement of adjacent differential signal pairs, providing a low pair-to-pair cross talk, is provided with substantially identical modules 115 in the connector 103, which reduces its manufacturing costs. The lines L provide substantially straight columns 117 on the circuit board 107, again facilitating manufacturing and/or tracing, etc.

The separation of the signal leads S forming a differential pair SS within one module and the separation between differential pairs, as well as the amount of staggering in adjacent modules may be adjusted to desired arrangements and/or values in this manner using substantially identical modules 115.

The lines L provide substantially straight columns 117 on the circuit board 107, and the contacts 113 are arranged in a regular grid-like array having columns and rows at perpendicular angles. The columns (and rows) of the circuit board 107 extend at the acute angle $\alpha$ to the columns (and rows) of the connector 103, wherein differential signal pairs SS in the columns 117 on the circuit board 107 correspond to differential signal pairs SS of different connector columns. Such regular contact arrangement may, inter alia, facilitate routing traces in and/or on the circuit board 107, and it may facilitate manufacture of and/or modelling of the circuit board 107.

The modules 115 may be manufactured as single objects, e.g. by overmoulding a lead frame array wherein the leads are cut, e.g. stamped, from a blank and have been formed, e.g. bent, out of the blank to different planes, and/or by overmoulding leads formed from a plurality of blanks. Alternatively, a module may comprise a number of sub-modules, each comprising a number of leads in an insulating housing which are combined to provide a module 115. This may facilitate manufacturing of each sub-module, reducing manufacturing costs for the connector 103 as a whole.

Figure 5:
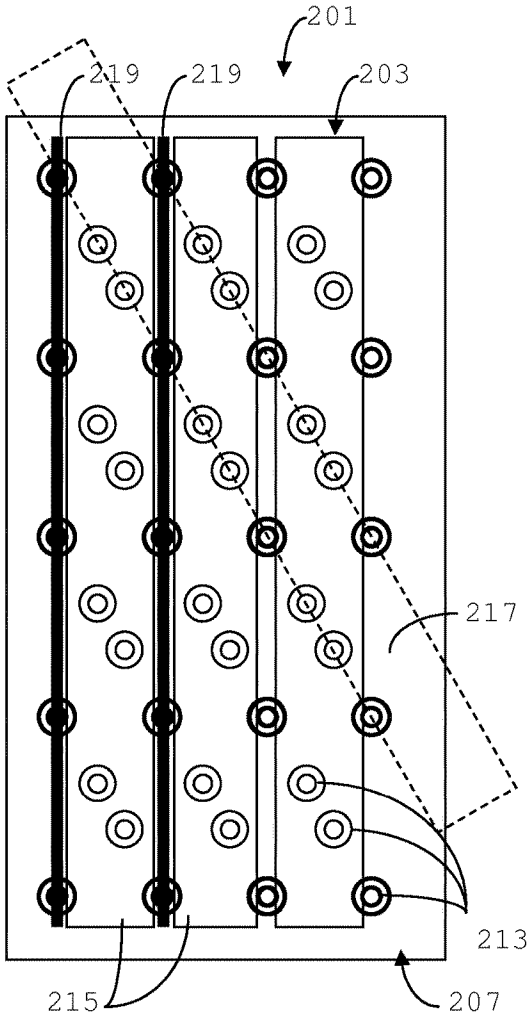
FIGS. 4-9 indicate conductor arrangements of improved assemblies.

FIG. 5 shows an assembly 201 being a further embodiment. In this assembly 201, the circuit board 217 is substantially identical to the board 117 of FIG. 4. Different from FIG. 4, in the connector 203 the modules 215 only comprise signal leads S, no ground leads. The relative arrangement of the signal leads S within the connector 203 is substantially identical to that of FIG. 4, with, at least in the cross section shown in FIG. 5, the pair directions P of differential signal pairs SS being at substantially identical angles $\alpha$ to the column direction C both within each module 215 and in each respective module 215. Further, the connector 203 comprises substantially plane shields 219 (only two shown) arranged adjacent and between the modules 215, shielding signal leads S in adjacent modules 215 from each other. The shields 219 are preferably formed corresponding to the modules 215, comprising a substantially solid shield body overlapping the dielectric housings 206 of the modules 215 and comprising shield contacts extending from the shield body for contacting the circuit board 207. Between the shield bodies, the differential signal pairs S in adjacent modules 215 are shielded from each other. Within each module, the separation between adjacent differential pairs SS and the rotation of their pair direction P with respect to the column direction C provide good separation against pair cross talk.

The shields 219 may comprise a rib, be embossed or comprise one or more otherwise structured portions to provide one or more grounded shielding portions, which shield portions may separate adjacent differential pairs SS within one column provided by a module 215, e.g. mimicking ground conductors G.

The shield contacts are mated to (the arrangement of) the contacts 213 of the circuit board 207, such that in the portion of the assembly 201 comprising the connector contacts 5C and the circuit board contacts 213, again lines of differential pairs SS separated by a ground contact G are provided with the differential pairs SS arranged in a staggered manner and forming substantially straight columns 217 on the circuit board 207. As in FIG. 4, in FIG. 5 a staggered arrangement of differential signal pairs is provided with substantially identical contact modules 215 (and shields 219).

Figure 6:
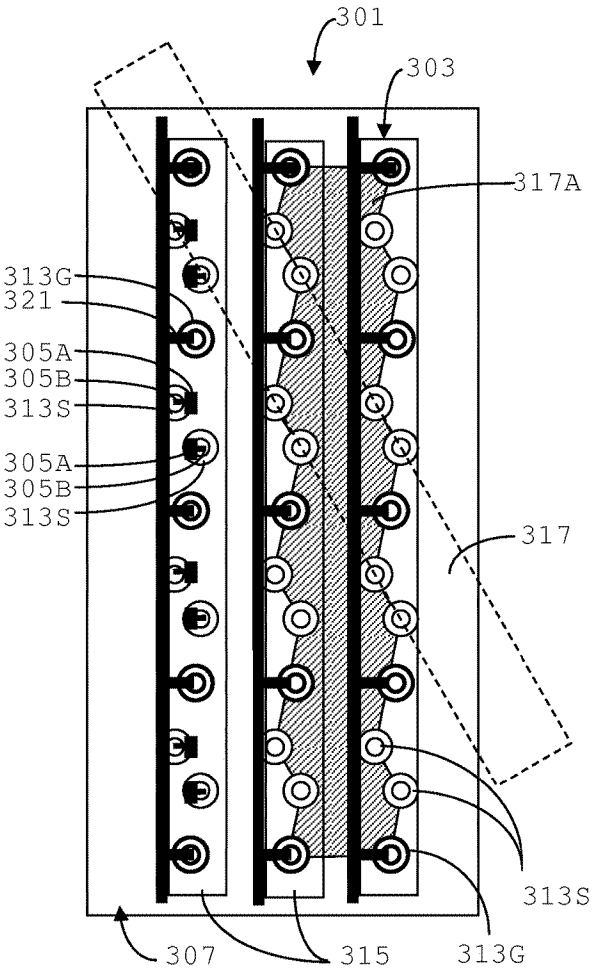

FIG. 6 shows an assembly 301 being a further embodiment. In the connector 303 of this embodiment, lead modules 315 comprise only leads 305 arranged as differential signal pairs SS. The lead portions 305A of each signal lead S extend substantially in a plane in the connector column direction C. As shown, for at least some signal leads 305 the board contact portion 305B extends outside of that plane and fits signal contacts 313S of the circuit board 307. Thus, the contacts 305B and 313S form portions of differential signal pairs SS with a pair direction P extending at an acute angle to the column direction C. The contacts 305B and 313S are again arranged in substantially straight lines spanning adjacent connector columns providing a staggered arrangement of differential pairs SS and providing substantially straight columns 317 on the circuit board 307.

Further, the shields 319 comprise shield contacts 321 extending from the plane of the shields and fitting associated contacts 313G on the circuit board 307. The contacts 313G are arranged such that in the straight columns 317 on the first circuit board 307 differential signal pairs SS in the column 317 are separated by a ground contact portion 321, 313G.

On the circuit board 307, one may also discern columns generally elongated but somewhat wavy columns 317A defined by the contacts 313S, 313G corresponding to the column direction C of the connector modules 315 (see hatched portion in FIG. 6). Tracing in and/or on the circuit board 307 may be arranged in such column 317 A too, which closely resembles the customary arrangement.

In a board mounting portion BMP where the leads 305 extend beyond the shields, the impedance and the pair cross talk shielding between differential signal pairs SS of adjacent connector columns is improved in the embodiment of FIG. 6. Also in the case of FIG. 6, a staggered arrangement of differential signal pairs SS in adjacent connector modules 315 may be provided with substantially identical modules 315 and shields 319.

As described for FIG. 5, the shields 319 may comprise ribs or other features extending at least partly into the columns provided by the modules 315 between adjacent differential signal pairs SS. Possibly, such extending shield portions may overlap a contact 313G so that the shield contacts 321 extend substantially straight from the shield to the associated contacts 313G.

In a variant to FIG. 6, not shown, one or more modules 315 may comprise ground leads overlapping contacts 313G and contacting these. In such case, a shield 319 may be obviated. In case a shield 319 is provided too, a shield contact 321 and a ground lead contact may both contact a single circuit board contact 313G. The circuit board 307 may be substantially identical.

Figure 7:
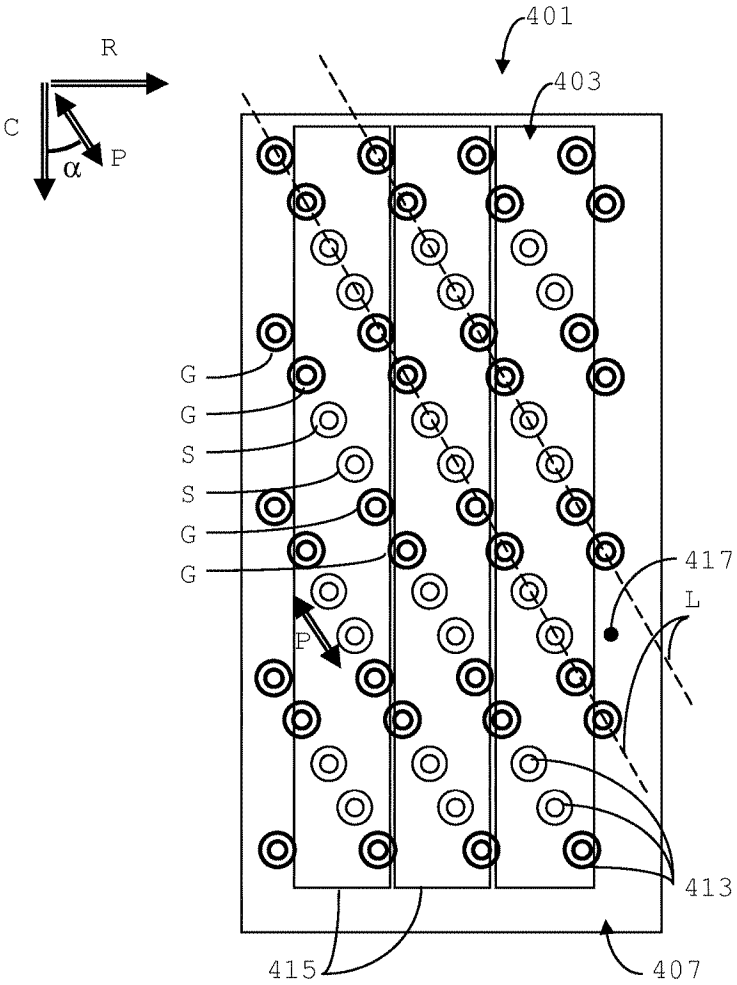
Figure 9:
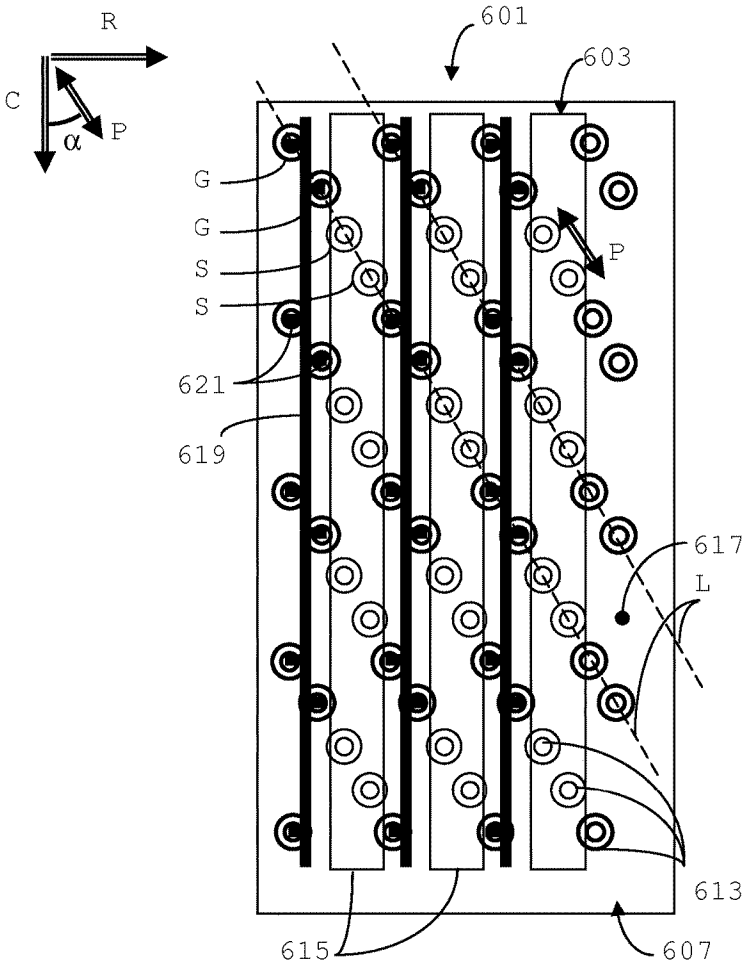
Figure 8:
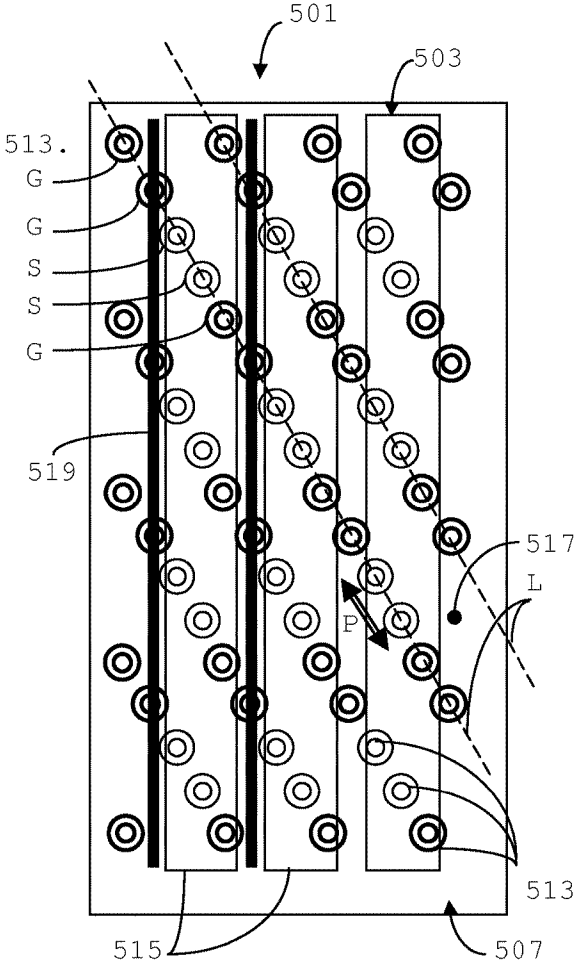
Figure 10A:
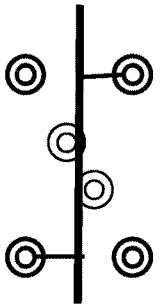
FIGS. 10A-10E indicate connections of grounds around a differential signal pair.
Figure 10B:
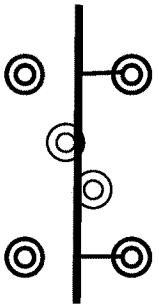
Figure 10C:
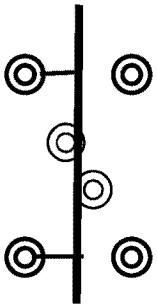
Figure 10D:
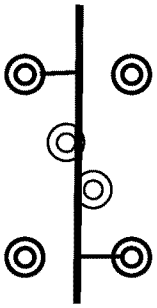
Figure 10E:
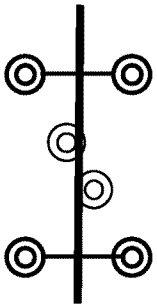

FIGS. 7-9 show assemblies 401, 501, 601, being further embodiments. In each of these embodiments, the first circuit board 407, 507, 607 comprise contacts 413, 513, 613 arranged in substantially straight lines L wherein differential signal pairs SS are arranged staggered between the lines and are separated by plural ground contacts G within the lines L. In each FIG. 7-9, the circuit boards 407, 507, 607 are substantially identical, with different connectors 403, 503, 603.

FIG. 7 shows that the connector 403 may comprise substantially identical modules 415 comprising, in at least a portion thereof, ground leads G pairwise surrounding differential signal pairs SS, effectively forming separate series of leads arranged as GSSG and extending diagonally with respect to the column direction C. Adjacent substantially identical modules 415 provide staggered differential signal pairs SS arranged in substantially straight lines L providing columns 417 arranged at an angle to the column direction C which may be used for tracing leads on the circuit board 407.

FIG. 8 shows that a number of circuit board ground contacts 513G may be used for contacting contacts of a shield 519, which may be substantially plane. The shield contacts 521 (not shown) may extend substantially in the plane of the shield 519. Other ground contact 513G may be used for a ground lead of a module 515 of the connector 503. Here, the ground contacts 513 of the circuit board 507 are used alternatingly.

FIG. 9 shows plane shields 619 comprising shield contacts 621 extending from the shields 619 in opposite directions and contacting adjacent ground contacts 613G in each line L.

It has been recognised that signal integrity of a differential signal may be improved when impedances of both signal leads are substantially identical. Thus, the arrangement of FIG. 7 facilitates providing symmetric impedances for the signal leads S making up a differential signal pair. In FIG. 8 all ground contacts 513 are interconnected by the shield 519, both shielding and defining a common potential across the contact lines L and along each module 515. In FIG. 9, symmetry of the impedance is improved as each differential signal pair SS is provided with a shield 619 on both opposite ends.

It has further been recognised that signal integrity of a differential signal may be significantly improved if adjacent grounds define substantially identical potentials. This is the case in FIG. 6.

Figure 11:
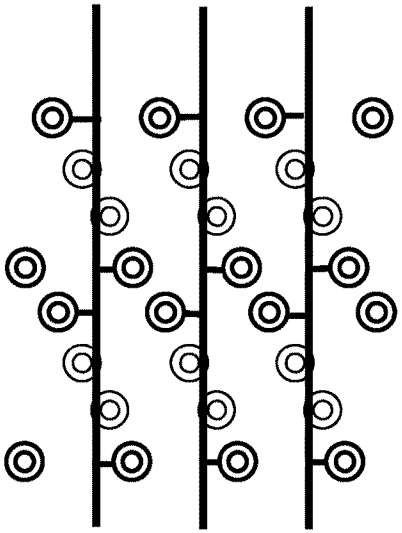
FIGS. 11-12 indicate different options for connecting grounds around plural differential signal pairs.
Figure 12:
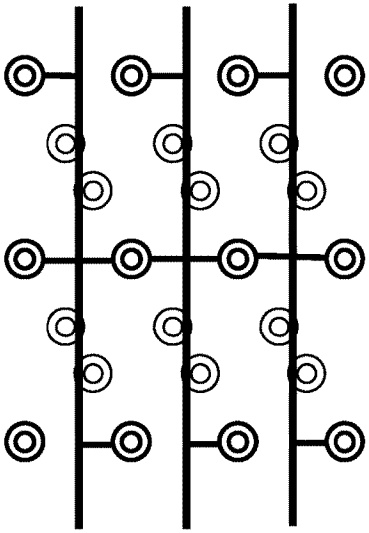

In FIGS. 10A-12 connection arrangements are shown (i.e., conductive channels, not necessarily physically formed the shown way) for improving definition of a common voltage on the grounds on opposite sides of rotated differential signal pairs SS. It is found to be important that the electrical path length between the ground leads G on opposite ends of a differential signal pair SS is reduced, and signal travelling times between the grounds G are minimised. The performance of the shown arrangements in terms of signal integrity and in particular in terms of pair cross talk between adjacent pairs improves going from FIG. 10A to FIG. 10E, with FIGS. 10B and 10C behaving substantially equal. FIG. 11 shows that implementing FIG. 10D is facilitated in the footprint arrangement of FIG. 7. The arrangement of FIG. 11 differs from FIG. 9 in the interconnection of grounds G for adjacent differential signal pairs SS (FIG. 9) or for a differential signal pair SS (FIG. 11) "enclosed" by grounds that are directly interconnected. FIG. 12 shows that repeating FIG. 10D may lead to FIG. 10E.

A connector comprising the layout of leads and/or shields according to FIG. 12 fits the circuit board 307 of FIG. 6.

To provide an assembly comprising a connector comprising plural modules and shields arranged between the modules, e.g. as in FIG. 5, 6, 8 or 9, adjacent shields may comprise shield contacts extending in opposite directions from the shield plane and, and both such contacts of adjacent shield may together contact the same circuit board contact (e.g. 313 of circuit board 307 of FIG. 6). Compared to each other, an assembly according to FIG. 11 facilitates manufacturing of the connector and an assembly according to FIG. 12 facilitates manufacturing of the circuit board as less contacts need be provided. FIG. 11 is particularly beneficial for solder pin or press-fit circuit board contacts. FIG. 12 particularly benefits surface mount contacts, e.g. solder contacts like a ball grid array.

Figure 13B:
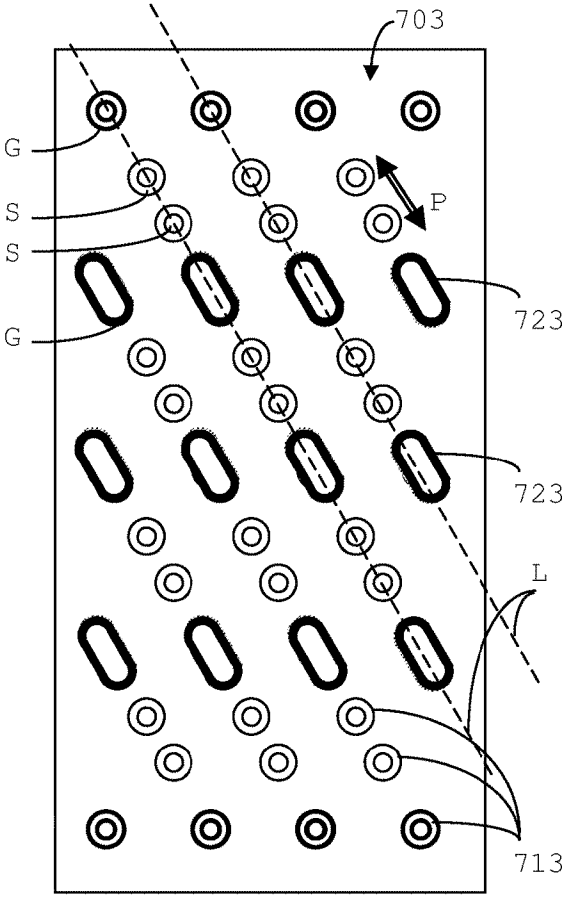
FIGS. 13A-13B indicate conductor arrangements of improved assemblies.
Figure 13A:
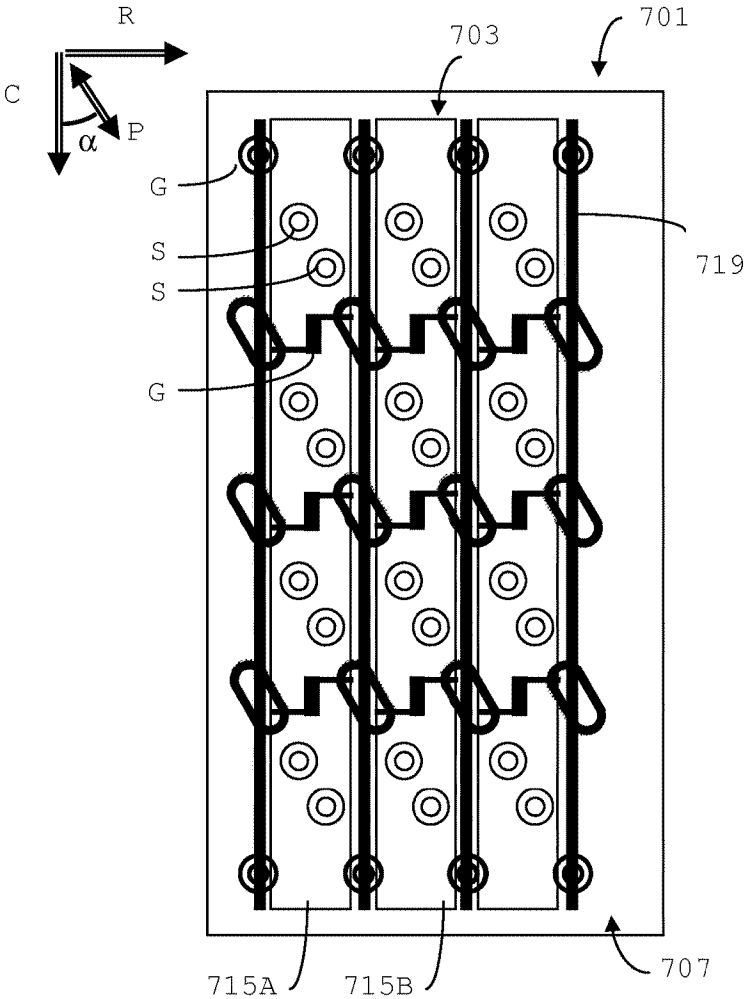

FIG. 13A indicates an embodiment of an assembly 701 and FIG. 13B indicates a circuit board 707 used in the assembly of FIG. 13A. In this case the circuit board 707 comprises elongated ground contacts 723 between adjacent differential signal pairs SS for contacting plural contacts from ground contacts and/or shield contacts of the connector, e.g. a connector 403, 503 or 603 according to FIGS. 7-9 or having an arrangement according to FIGS. 10A-12. Here, the elongated ground contacts 723 are comprised in a line L comprising plural differential pair contacts SS separated by the ground contacts G and they extend in the differential pair direction P along the line L. The elongated contacts 723 may e.g. comprise slotted holes for solder pin or press-fit contacts and/or solder islands for surface mount contacts.

The connector 703 shown in FIG. 13A comprises connector modules 715 and optional shields 719 between at least some modules 715. Each module 715 comprises signal leads S forming a differential pair SS at an acute angle to the column direction C and a ground lead G between adjacent differential pairs SS. The ground leads G are connected to elongated ground contacts 723 on opposite sides of the modules 715, except for the outermost ground leads G which are connected to a non-elongated ground contact 713. The shields 719 are also connected to the elongated contacts 723. The modules 715 may comprise further ground leads G on the top and/or bottom of the columns formed by the modules 715 (not shown). In the shown embodiment the shields 719 provide the ground conductors at that position. The ground contacts 713 on the top and/or bottom of each column C may be interconnected via traces on the circuit board and/or interconnections between the shields 719 in the connector (not shown). Compared to the, theoretically considered, best arrangements of FIGS. 10D-12, FIG. 13A provides only a small extension of the electrical path length between the ground leads G and provide a good approximation of the ideal behaviour.

Figure 15:
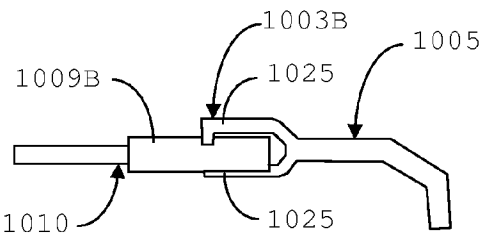
FIG. 15 is a side view of a contacted assembly of a contact and a counter contact.
Figure 14:
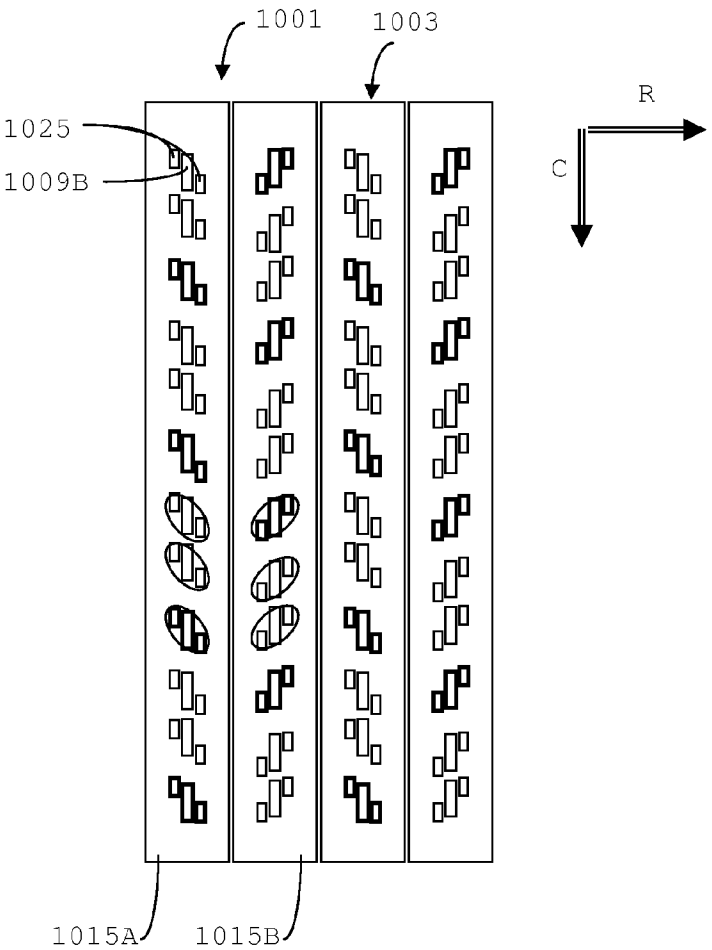
FIG. 14 shows a contact-counter contact arrangement in cross section.

FIG. 14 shows a cross sectional view of the mating portion MP in an embodiment of an assembly 1001 comprising a connector 1003 and a counterconnector 1009. The connector 1003 is a receptacle connector comprising leads 1005 with receptacle contacts 1003B of the tuning fork type having opposing arms 1025 and the counterconnector 1009 is a header 1009 comprising leads 1010 with blade contacts 1009B. FIG. 15 shows a side view of a blade contact 1009B received in a receptacle contact 1003B.

The connector 1003 of FIG. 14 comprises plural modules 1015. The header contacts 1009B are arranged according to the known arrangement of FIG. 3, providing straight columns of differential pairs SS having a pair direction P extending in the column direction C, being separated by ground contacts G and being staggered in the row direction R. Best seen in FIG. 14, the arms 1025 of the receptacle contact 1009B are arranged on opposite sides and towards opposite ends (top and bottom) of the contact blades 1009B. Thus, a conductive mass is formed by the contact portions having a generally elongated shape in cross section (see ellipses in FIG. 14). The orientation of the elongated shape is at an acute effective angle to the column direction C. In the connector 1003, adjacent columns 1015A, 1015B comprise receptacle contacts 1003B of which the arms 1025 are arranged opposite with respect to each other, so that the direction of elongation of the contacted contacts is generally opposite each other with respect to the column direction C. Such connector arrangement already provides improved over a known connector with a symmetric contact arrangement.

FIGS. 16 and 17 show views similar to FIG. 14 of embodiments comprising connectors according to FIG. 4 having substantially identical modules 1115 and 1215, respectively. In FIG. 16, the direction of elongation of the contact mass is substantially parallel to the pair direction P. In FIG. 17, the direction of elongation of the contact mass is substantially perpendicular to the pair direction P. In FIG. 16, interaction, e.g. edge coupling, between signal leads of one differential pair may be strong, whereas interaction between adjacent staggered differential pairs is significantly lower, e.g. due to the different distances of the leads within one differential pair relative to the leads of adjacent staggered differential pairs. Coupling between the lower signal lead of one pair and the upper lead of the adjacent pair is primarily capacitively. In FIG. 17, the leads of one differential pair exhibit primarily capacitive coupling, whereas interaction between the lower signal lead of one pair and the upper lead of the adjacent pair is primarily via edge type coupling. Thus, by selecting the shape and orientation of the contact mass, a desired coupling may be achieved, in addition to the staggering of the differential pairs in diagonal direction with respect to the column direction C.

FIG. 18 shows yet a further embodiment in a cross sectional view as in FIGS. 14, 15-17. Here, the connector 1303 comprises adjacent columns 1315A, 1315B which differ from each other in that in adjacent columns the pair direction P of the differential pairs SS is generally opposite to each other as indicated above each column. Within each column 1315A, 1315B, the elongated conductor mass provided by the contacts is generally along, here generally parallel to, the pair direction P.

Minimal inter-pair cross talk is achieved between a first differential pair SS1 having signal leads "a" and "b" and a second differential pair SS2 having signal leads "c" and "d" when the following equation is minimised, according to the well-known "QUADS"-principle:

$$CT(SS1.2)=\{CT(a.c)+CT(b.d)\}-\{CT(a.d)+CT(c.b)\},$$

wherein CT(SS1.2) is the cross talk noise strength between the pairs SS1 and SS2 and CT(*a.b*) . . . is the differential cross talk between the leads "a" and "b" etc.

It is presently believed that pair cross talk is minimised for a regular arrangement wherein the leads a-d are arranged on the corners of a rhombus, possibly a diamond, and preferably being shielded from further differential pairs SS by grounds along (extensions of) the sides, or (extensions of) the main axes of the rhombus. The exact shape of the arrangement may depend on the shape of the conductors involved. The presented embodiments provide close approximations to such optimal arrangement, and generally provide reduced manufacturing costs.

The invention is not restricted to the above described embodiments which can be varied in a number of ways within the scope of the claims. For instance, the number of leads in the connector and details of their arrangement may vary. More or less shield may be provided. A modular connector may comprise different modules, including modules having more or less leads than an adjacent module or no leads at all, e.g. acting as a spacer or an insulator. Leads may comprise different contacts. In a footprint, a top and/or bottom row need not be straight.

In a connector the leads may be arranged as shown here only in a contact portion or a lead portion and not in one or more other portions, e.g. with the lead portions being arranged in a pair direction in parallel to the column direction C (cf. FIGS. 2 and 3) and with contact portions arranged with their pair direction rotated in an acute angle to the column direction C, e.g. as in FIG. 4, e.g. for reasons of adjusting impedance of the pair. However, it is presently considered beneficial if the differential pairs SS have an acute angle to the column direction substantially along the entire lengths of their respective signal leads.

Further, elements and aspects discussed for or in relation with a particular embodiment may be suitably combined with elements and aspects of other embodiments, unless explicitly stated otherwise.

The invention claimed is:

1. A connector comprising:

a plurality of leads arranged in a plurality of groups, wherein the plurality of groups are arranged in columns extending substantially parallel to each other in a column direction and being adjacent to each other in a row direction perpendicular to the column direction, wherein:

at least a portion of the connector comprises a first plurality of groups of the plurality of groups, the groups of the first plurality of groups each comprising a differential pair of signal leads and a ground lead, each lead of the first plurality of groups has a contact portion, a mating portion opposite the contact portion, and a third portion that extends between the contact portion and the mating portion, the third portion being substantially along a length of said lead, for each group of the first plurality of groups, one or more portions of the differential pair of signal leads and the ground lead are substantially aligned along a line, the one or more portions comprising the third portion of the differential pair of signal leads and of the ground lead, the lines of the first plurality of groups extend at an acute angle to the column direction, and the mating portion of a lead of the first plurality of groups comprises two arms arranged parallel to the lines of the first plurality of groups.

2. The connector of claim 1, wherein the lines of the first plurality of groups are substantially parallel to each other, and wherein the portion of the connector comprises first and second ones of the columns, the first column being adjacent to the second column, and the lines of the groups in the first column and the second column being generally parallel to each other.

3. The connector of claim 1, wherein:

for each group of the first plurality of groups, the one or more portions of the differential pair of signal leads and the ground lead comprise the contact portion of the differential pair of signal leads and of the ground lead.

4. The connector of claim 1, wherein the connector comprises a plurality of lead frames, and each lead frame within the portion comprises the plurality of groups arranged in a column.

5. The connector of claim 1, wherein the connector comprises one or more shields extending between adjacent columns.

6. The connector of claim 5, wherein one or more of the shields extend generally in a plane and wherein the shield comprises shield contacts extending outside the plane, and the shield contacts comprise leads of the plurality of leads, with each group of the plurality of groups comprising at least one shield contact.

7. The connector of claim 1, wherein:

differential pairs of the first plurality of groups are arranged on the corners of rhombuses, the rhombuses comprise main axes joining the opposite corners, and sides joining the neighboring corners and forming first angles being equal to a complementary angle of the acute angle and second angles being equal to a supplementary angle of the first angles, and ground leads of the plurality of groups are arranged along extensions of the sides and/or the main axes of the rhombuses.

8. The connector of claim 1, wherein the connector comprises a row of lead modules providing one or more columns.

9. The connector of claim 1, for each group of the first plurality of groups, the one or more portions of the differential pair of signal leads and the ground leads comprises only the third portion of the differential pair of signal leads and of the ground leads.

10. An assembly comprising the connector of claim 1 and a counterconnector, wherein the contact portions of the differential pairs of the connector are configured to contact counter contacts of the counterconnector, and wherein each pair of the contact portion and mated counter contact, when contacted, together form a conductive mass having a generally elongated shape in cross section, with a direction of elongation substantially parallel to or substantially perpendicular to the respective line of the differential pair.

11. An assembly comprising the connector of claim 1 and a circuit board, wherein the circuit board comprises signal contacts and ground contacts generally arranged in lines comprising a plurality of differential pair contacts separated by one or more ground contacts.

12. The assembly of claim 11, wherein the circuit board comprises a footprint for accommodating the connector, the footprint having a substantially rectangular or elongated shape with respect to column and row directions perpendicular to each other, and having differential pair contacts arranged generally in lines at the acute angle to the column and row directions, such that routing channels are formed in the circuit board between the lines.

13. A connector comprising:

a plurality of leads arranged in a plurality of groups, wherein:

the plurality of groups are arranged in columns extending substantially parallel to each other in a column direction and being adjacent to each other in a row direction perpendicular to the column direction, wherein adjacent groups of the plurality of groups in each column of the columns are spaced apart in the column direction, at least a portion of the connector comprises a first plurality of groups of a differential pair of signal leads and a ground lead, each lead of the first plurality of groups having a contact portion, a mating portion opposite the contact portion, and a third portion that extends between the contact portion and the mating portion, the third portion being held by a housing, for each group of the first plurality of groups, the contact portions and mating portions and third portions of the differential pair of signal leads and the ground lead are substantially aligned along a line, respectively, and the lines of the groups extend at an acute angle to the column direction, and the mating portion of a lead of the first plurality of groups comprises two arms arranged parallel to the lines of the first plurality of groups.

14. The connector of claim 13, comprising:

a plurality of ground shields, each comprising a plurality of ground leads of the plurality of leads arranged in the plurality of groups.

15. A connector comprising:

a plurality of modules, each module being elongated in a column direction, and the plurality of modules being aligned in a row direction perpendicular to the column direction, wherein each module comprises a plurality of signal leads disposed in pairs spaced apart from each other in the column direction, wherein the connector further comprises ground leads, and wherein at least a portion of the connector comprises a first plurality of modules of the plurality of modules, the modules of the first plurality of modules each comprising the plurality of signal leads and ground leads arranged to form a plurality of groups of at least three leads, each group comprising a differential pair of signal leads and at least one ground lead, wherein:

each lead of the plurality of groups has a contact portion, a mating portion opposite the contact portion, and a third portion that extends between the contact portion and the mating portion, the third portion being enveloped by a dielectric housing material, for each group of the plurality of groups, the third portions of the differential pair of signal leads and the ground lead are substantially aligned with each other along a line, the lines of the groups are parallel to each other and extend at an acute angle to the column direction, and the mating portion of a lead of the first plurality of groups comprises two arms arranged parallel to the lines of the first plurality of groups.

16. The connector of claim 15, wherein for each group of the plurality of groups, the contact portions of the differential pair of signal leads and the ground lead are aligned substantially parallel to the column direction.

17. The connector of claim 15, further comprising shields between the modules, wherein the shields have contact portions extending therefrom, and wherein the ground leads comprise contact portions of the shields.

18. The connector of claim 17, wherein the shields comprise two opposing surfaces and the contact portions extend in the row direction from the two opposing surfaces such that contact portions of each shield comprise leads of the plurality of leads, with each group of the plurality of groups comprising at least one contact portion of the shields.

19. The connector of claim 17, in combination with a printed circuit board, wherein:

the printed circuit board comprises a footprint for the connector comprising a plurality of contacts, and the contact portions of the signal leads and ground leads are attached to respective contacts of the printed circuit board; and the plurality of contacts of the printed circuit board are disposed along lines, parallel to each other and at the acute angle to the column direction such that routing channels at the acute angle are formed through the footprint.

* * * * *